US006181060B1

(12) United States Patent
Rolfson

(10) Patent No.: US 6,181,060 B1
(45) **Date of Patent: *Jan. 30, 2001**

(54) FIELD EMISSION DISPLAY WITH PLURAL DIELECTRIC LAYERS

(75) Inventor: J. Brett Rolfson, Boise, ID (US)

(73) Assignee: Micron Technology, Inc., Boise, ID (US)

( * ) Notice: Under 35 U.S.C. 154(b), the term of this patent shall be extended for 0 days.

This patent is subject to a terminal disclaimer.

(21) Appl. No.: 09/114,648

(22) Filed: Jul. 13, 1998

Related U.S. Application Data

(62) Division of application No. 08/744,512, filed on Nov. 6, 1996, now Pat. No. 6,022,256.

(51) Int. Cl.[7] ..... H01J 1/304; H01J 19/24

(52) U.S. Cl. ..... 313/495; 313/309; 313/351; 313/336

(58) Field of Search ..... 313/309, 336, 313/351, 310, 495, 496, 497; 445/50, 24

(56) References Cited

U.S. PATENT DOCUMENTS

| | | | |
|---|---|---|---|
| 3,665,241 | 5/1972 | Spindt et al. | 313/351 |
| 3,721,022 | 3/1973 | Mercorelli | 35/77 |
| 3,755,704 | 8/1973 | Spindt et al. | 313/309 |
| 3,789,471 | 2/1974 | Spindt et al. | 29/25.17 |
| 3,812,559 | 5/1974 | Spindt et al. | 29/25.18 |
| 3,875,442 | 4/1975 | Wasa et al. | 313/193 |
| 3,921,022 | 11/1975 | Levine | 313/309 |
| 3,970,887 | 7/1976 | Smith et al. | 313/309 |
| 3,998,678 | 12/1976 | Fukase et al. | 156/3 |
| 4,663,559 | 5/1987 | Christensen | 313/336 |
| 4,666,553 | 5/1987 | Blumenfeld et al. | 156/643 |
| 4,671,851 | 6/1987 | Beyer et al. | 156/645 |
| 4,746,629 | 5/1988 | Hanagasaki | 437/162 |
| 4,763,187 | 8/1988 | Biberian | 358/56 |
| 4,766,340 | 8/1988 | van der Mast et al. | 313/366 |
| 4,857,161 | 8/1989 | Borel et al. | 204/192.26 |
| 4,857,799 | 8/1989 | Spindt et al. | 313/495 |

(List continued on next page.)

FOREIGN PATENT DOCUMENTS

| | | | |
|---|---|---|---|
| 0 520 780 A1 | 12/1992 | (EP) | H01J/9/02 |
| 49-122269 | 11/1974 | (JP) . | |
| 51-21471 | 2/1976 | (JP) | H01J/1/30 |
| 51-120167 | 10/1976 | (JP) | H01J/9/02 |
| 51-119164 | 10/1977 | (JP) | H01J/1/30 |
| 52-132771 | 11/1977 | (JP) | H01J/1/30 |
| 56-160740 | 12/1981 | (JP) | H01J/9/02 |
| 61-120424 | 6/1986 | (JP) | H01L/21/304 |
| 1-128332 | 5/1989 | (JP) | H01J/1/30 |
| 3-22329 | 1/1991 | (JP) | H01J/31/12 |
| 3-194829 | 8/1991 | (JP) | H01J/19/24 |
| 5-21002 | 9/1993 | (JP) | H01J/9/02 |
| 5-21003 | 9/1993 | (JP) | H01J/9/02 |

OTHER PUBLICATIONS

M. Sokolich et al., "Field Emission From Submicron Emitter Arrays," IEEE, International Electron Devices Meeting, San Francisco, CA., Dec. 9–12, 1990, pp. 159–162.

Liut et al., "Fabrication of self–aligned gated field emitters," Dept. of Electrical Eng., New Jersey Inst. of Technology, Jan. 1992, pp. 21–24.

"Extended Abstracts," The Japan Society of Applied Physics, (The 53rd Autumn Meeting, 1992), p. 553.

Stanley Wolf Ph.D., "Silicon Processing For the VLSI Era," vol. 2: Process Integration, p. 239.

*Primary Examiner*—Michael H. Day
(74) *Attorney, Agent, or Firm*—Fletcher, Yoder & Van Someren

(57) ABSTRACT

A field emission display (10) includes an emission tip (16), an insulating layer (18) having composite insulating layers (18A–18C), and a conductive gate (20). The composite insulating layers (18A–18C) include a selectively etchable insulating layer (18B), and reduce leakage current from the base of the emission tip (16) to the gate (20).

33 Claims, 3 Drawing Sheets

U.S. PATENT DOCUMENTS

| | | | |
|---|---|---|---|
| 4,943,343 | 7/1990 | Bardai et al. | 156/643 |
| 4,964,946 | 10/1990 | Gray et al. | 156/643 |
| 5,012,153 | 4/1991 | Atkinson et al. | 313/336 |
| 5,036,015 | 7/1991 | Sandhu et al. | 437/8 |
| 5,038,070 | 8/1991 | Bardai et al. | 313/309 |
| 5,055,158 | 10/1991 | Gallagher et al. | 156/643 |
| 5,057,047 | 10/1991 | Greene et al. | 445/24 |
| 5,070,282 | 12/1991 | Epsztein | 315/383 |
| 5,075,591 | 12/1991 | Holmberg | 313/495 |
| 5,143,820 | 9/1992 | Kotecha et al. | 430/314 |
| 5,151,061 | 9/1992 | Sandhu | 445/24 |
| 5,186,670 | 2/1993 | Doan et al. | 445/24 |
| 5,188,977 | 2/1993 | Stengl et al. | 437/89 |
| 5,191,217 | 3/1993 | Kane et al. | 250/423 |
| 5,209,687 | 5/1993 | Konishi | 445/6 |
| 5,229,331 | 7/1993 | Doan et al. | 437/228 |
| 5,232,549 | 8/1993 | Cathey et al. | 456/633 |
| 5,259,799 | 11/1993 | Doan et al. | 445/24 |
| 5,266,530 | 11/1993 | Bagley et al. | 437/228 |
| 5,302,238 | 4/1994 | Roe et al. | 156/643 |
| 5,372,973 | 12/1994 | Doan et al. | 437/228 |
| 5,378,182 | 1/1995 | Liu | 445/24 |
| 5,394,006 | 2/1995 | Liu | 257/506 |
| 5,653,619 | 8/1997 | Cloud et al. | 445/24 |
| 5,696,028 | 12/1997 | Rolfson et al. | 437/228 |

FIELD EMISSION DISPLAY WITH PLURAL DIELECTRIC LAYERS

This application is a Divisional of application Ser. No. 08/744,512 filed Nov. 6, 1996, now U.S. Pat. No. 6,022,256.

FIELD OF THE INVENTION

This invention relates to field emission devices and, more particularly, to processes for sharpening the emission tip of field emission devices.

BACKGROUND OF THE INVENTION

Cathode ray tube (CRT) displays, such as those commonly used in desk-top computer screens, function as a result of a scanning electron beam from an electron gun impinging on phosphors on a relatively distant screen. The electrons increase the energy level of the phosphors. When the phosphors return to their normal energy level, they release the energy from the electrons as a photon of light which is transmitted through the glass screen of the display to the viewer. One disadvantage of a CRT is the depth of the display required to accommodate the raster scanner.

Flat panel displays have become increasingly important in appliances requiring lightweight portable screens. Currently, such screens use electroluminescent or liquid crystal technology. Another promising technology is the use of a matrix-addressable array of cold cathode emission devices to excite phosphor on a screen, often referred to as a field emission display. To produce the desired field emission, a potential source is provided with its positive terminal connected to the gate, or grid, and its negative terminal connected to the emission electrode (cathode conductor substrate). The potential source is variable for the purpose of controlling the electron emission current. Upon application of a potential between the electrodes, an electric field is established between the emission tips and the low potential anode grid, thus causing electrons to be emitted from the cathode tips through the holes in the grid electrode.

The clarity, or resolution, of a field emission display is a function of a number of factors, including emission tip sharpness, alignment and spacing of the gates, or grid openings, which surround the tips, pixel size, as well as cathode-to-gate and cathode-to-screen voltages. These factors are also interrelated. For example, the voltage required for electron emission from the emission tips is a function of both cathode-to-gate spacing and tip sharpness. A relatively sharper emission tip may both improve resolution and lower power consumption.

Existing techniques for sharpening the emission tip typically involve an oxidation process followed by an etch process. The surface of the semiconductor substrate, such as silicon, and the emission tip are first oxidized to produce an oxide layer of $SiO_2$, which is then etched to sharpen the tip. The oxidation process is ordinarily either a wet or a dry process. In a dry oxidation process, the substrate and emission tip are exposed to an atmosphere containing a significant percentage of gaseous oxygen at temperatures of 800° C. or more. In a wet oxidation process the substrate and tip are exposed to steam at around 800° C.

In either existing oxidation technique, there is the risk that the oxidation process itself will induce flow of silicon and oxide, that is, cause the silicon and the forming oxide layer near the top of the emission tip to, in essence, flow down the sloping sides of the tip. This flowing action results in an undesirable rounding of the tip. In a dry process, oxidation typically does not appreciably occur below 800° C.

However, at temperatures above 800° C., flow of silicon and oxide can readily occur. A wet process will usually grow a sufficient oxide layer at 800° C., however, the chemical nature of existing wet processes can nevertheless lead to significant flow of silicon and oxide.

SUMMARY OF THE INVENTION

In one aspect of the present invention, a method of sharpening the emission tip in a field emission device that has a semiconductor substrate is provided. The method includes the steps of forming an insulating layer on the semiconductor substrate and the emission tip by exposing the semiconductor substrate and the emission tip to a mixture of gases containing oxygen and ozone, and selectively removing a portion of the insulating layer to expose the emission tip.

In another aspect of the present invention, a method for manufacturing a field emission display having reduced surface leakage is provided. In the method at least one emission tip is formed on a substrate and a first insulator is disposed on the emission tip by exposing the substrate and the emission tip to a mixture of gases containing oxygen and ozone. A second insulator is disposed on the first insulator. The second insulator is selectively etchable to the first insulator. A third insulator is disposed on the second insulator. The second insulator is selectively etchable to the third insulator. A conductive layer is disposed on the insulators. The insulators and the conductive layer are planarized, and portions of the insulators are selectively removed to expose the emission tip.

In still another aspect of the present invention, a field emission display having reduced surface leakage is provided. The field emission display includes a semiconductor substrate and at least one emission tip. The at least one emission tip is sharpened by forming an insulating layer on the semiconductor substrate and the emission tip by exposing the semiconductor substrate and the emission tip to a mixture of gases containing oxygen and ozone and selectively removing a portion of the insulating layer to expose the emission tip to leave a dielectric region surrounding the emission tip. The field emission display also includes a conductive gate that is disposed on the dielectric region.

BRIEF DESCRIPTION OF THE DRAWINGS

The present invention will be better understood from reading the following description of embodiments, with reference to the attached drawings, wherein below.

DETAILED DESCRIPTION OF THE SPECIFIC EMBODIMENTS

Conventional Apparatus and Process

Figure 1:
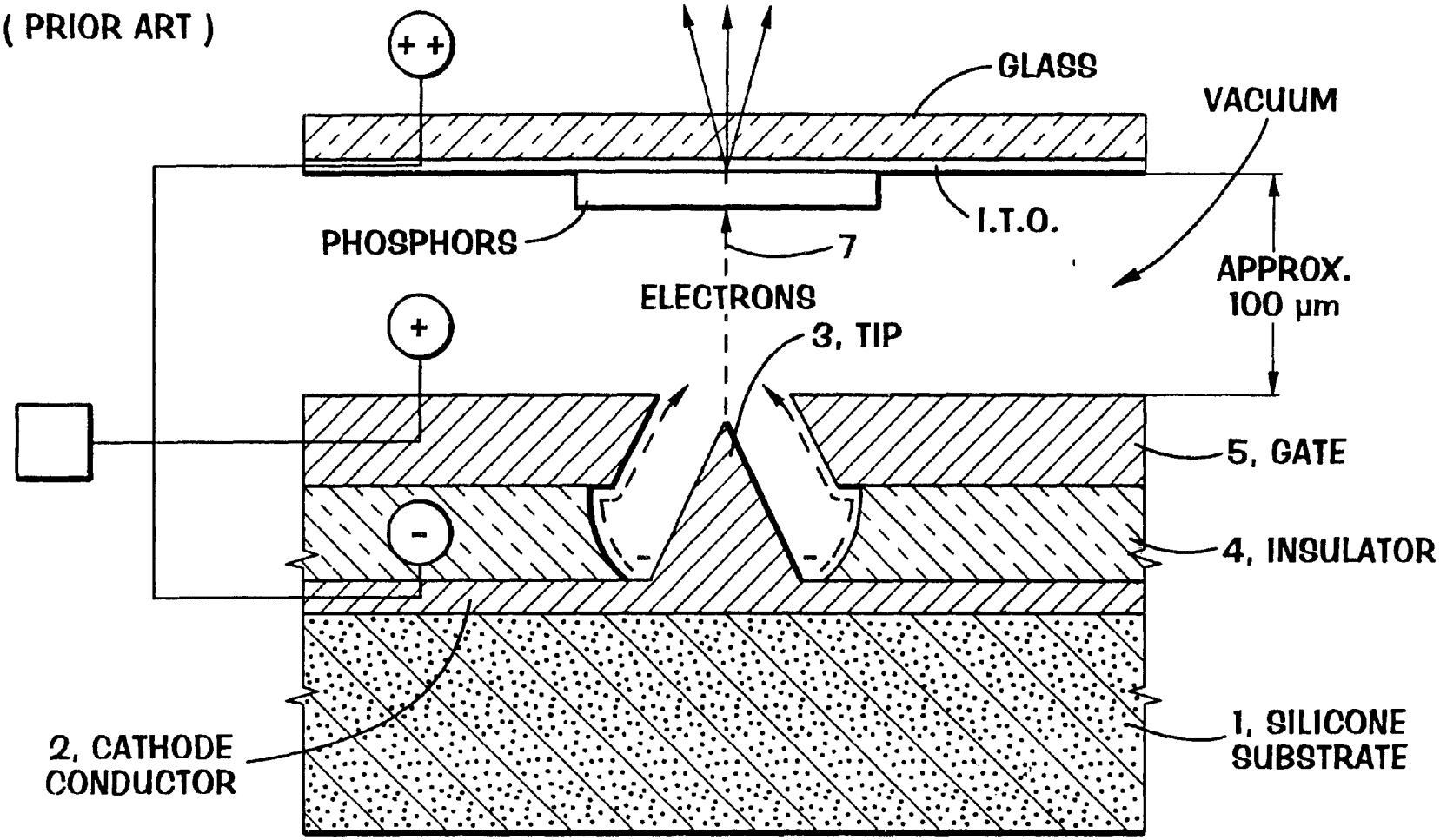
FIG. 1 ( PRIOR ART )
FIG. 1 is a cross-sectional schematic drawing of a conventional field emission display.

Referring to FIG. 1, a conventional field emission display employing a cold cathode is depicted. The substrate 1 is typically comprised of a suitable semiconductor material, such as silicon. At a field emission site location, a conductive cathode layer 2 is placed over the substrate 1. A upwardly projecting conical microcathode or emission tip 3 has been formed on the conductive cathode layer 2. A low potential anode gate structure 5 surrounds the emission tip 3. When a voltage differential, through a source 6, is applied between the emission tip 3 and the gate 5, a stream of electrons 7 is emitted toward a phosphor coated screen 8. The screen 8 functions as an anode. The electron emission tip 3 serves as a cathode conductor. The gate 5 serves as a low potential anode or grid structure for its respective emission tip 3. A dielectric insulating layer 4 is located on the conductive cathode layer 2. The insulator 4 also has an opening at the field emission site location.

The dotted lines in FIG. 1 illustrate the paths followed by electrons that have leaked from the emission tip 3. The emission tip 3 has a negative charge relative to the gate 5. Although the electron stream 7 emanates from the apex of the emission tip 3, some of the electrons 7 leak from the base of the emission tip 3 to the gate 5 largely traveling along the insulator 4 between them. The surface leakage from the emission tip 3 to gate 5 is a parasitic power loss, as well as a potential source for generating a destructive arc.

Embodiment of the Present Invention

Figure 3:
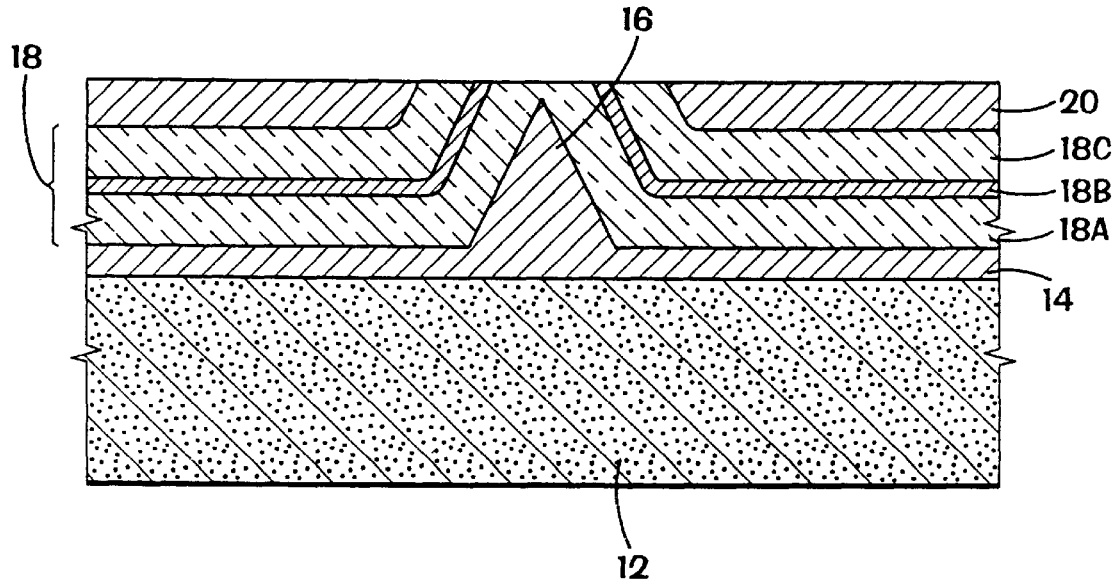
FIG. 3 is a cross-sectional schematic drawing of the electron emission tip of FIG. 2, after a mechanical planarization step has been performed, in accordance with the present invention.
Figure 4:
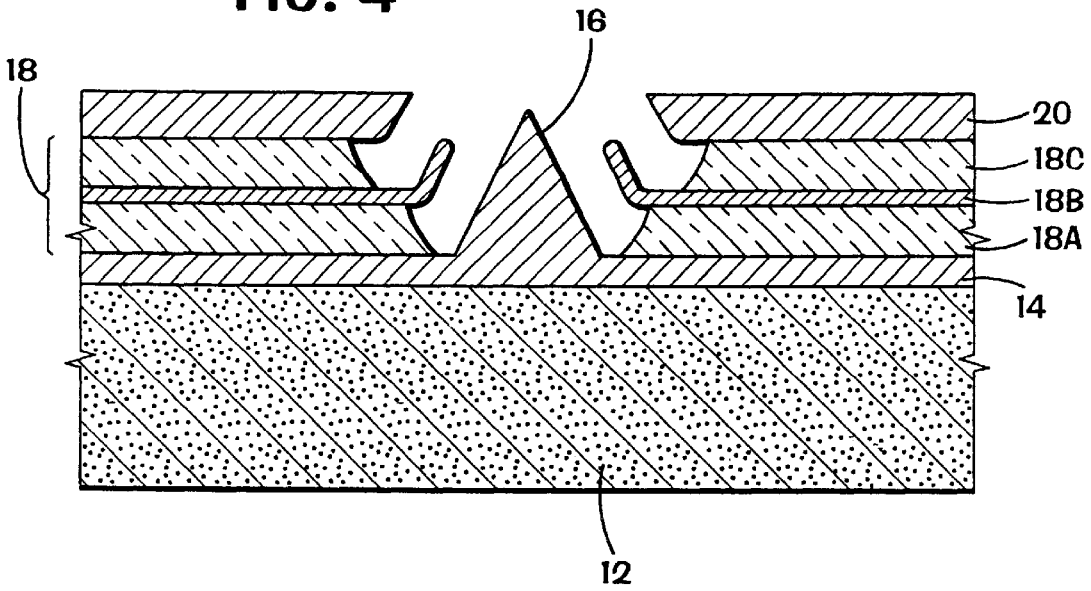
FIG. 4 is a cross-sectional schematic drawing of the electron emission tip of FIG. 3, after the insulating layers have undergone an etching process to expose the emission tip, in accordance with the present invention.
Figure 5:
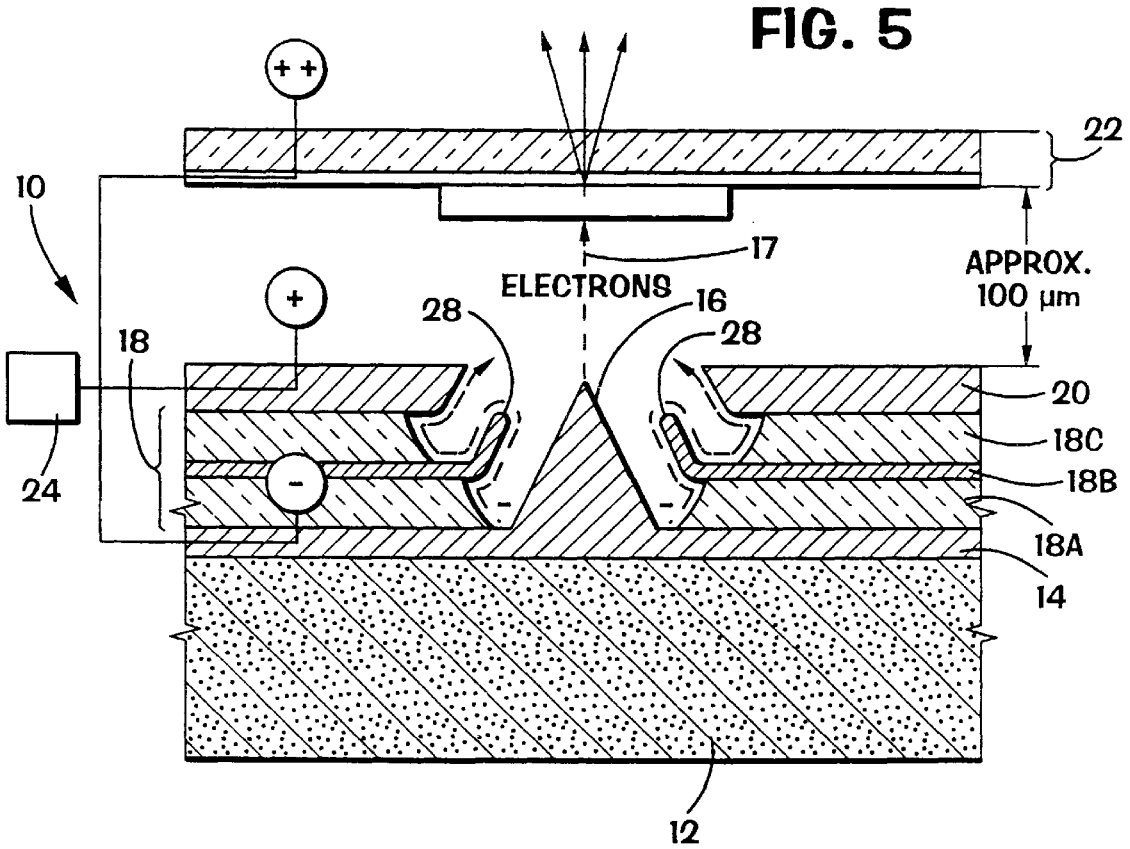
FIG. 5 is a cross-sectional schematic drawing of a field emission display in accordance with the present invention.

The embodiments of the present invention are best understood with reference to FIGS. 2–5 of the drawings which depict the initial, intermediate and final structures produced by a series of manufacturing steps in accordance with the present invention. A finished field emission display 10 is shown in FIG. 5 and includes a substrate 12 and a cathode conductor layer 14 disposed on the substrate 12. A portion of the cathode conductor layer 14 is formed into a conical emission tip 16. An insulator layer 18 is disposed on the cathode layer 14. The insulator layer 18 also has an opening at the field emission site location. A gate layer 20 is disposed on the insulator layer 18. The gate layer 20 serves as a low potential anode or grid structure for its emission tip 16. A phosphor screen 22 that functions as an anode is disposed over the emission tip 16. When a voltage differential, through a source 24, is applied between the emission tip 16 and the gate 20, a stream of electrons 26 is emitted toward the screen 22.

Initially, the substrate 12 is provided and selectively masked at the future field emission cathode sites. The substrate 12 may be formed from silicon, silicon-on-insulator, silicon-on-sapphire or similar materials. Thereafter, the emission tip 16 is formed by selective sidewise removal of the underlying peripheral surrounding regions of the semiconductor substrate 12 beneath the edges of the masked island areas. The result is the production of the centrally disposed, raised, field emission tip 16 in the region immediately under each masked island area defining a field emission cathode site. There are several methods by which to form the electron emission tip 16. Examples of such methods are disclosed in U.S. Pat. No. 3,970,887 entitled, "Micro-structure Field Emission Electron Source;" U.S. Pat. No. 5,302,238 entitled, "Plasma Dry Etch to Produce Atomically Sharp Asperities Useful as Cold Cathodes;" and U.S. Pat. No. 5,391,259 entitled, "A Method of Forming a Substantially Uniform Array of Sharp Tips," all of which are incorporated herein by reference.

In an embodiment of the present invention, the emission tip 16 is sharpened through an oxidation process before beginning the gate 20 formation process. The surface of the silicon wafer (Si), or other substrate, 12 and the emission tip 16 are oxidized to produce an oxide layer of $SiO_2$, which is then etched to sharpen the tip 16. Any conventional, known oxidation process may be employed in forming the $SiO_2$, and etching the emission tip 16.

In an alternative embodiment of the process of the present invention, the emission tip 16 is sharpened through an oxidation process during gate 20 formation. As will be discussed below, the process of the present invention employs an oxide layer 18*a* proximate to the emission tip 16 which electrically and physically separates the emission tip 16 from the gate 20.

After the formation of the emission tip 16, a composite insulating (dielectric) layer 18 is formed. The insulative layer 18 is termed composite to illustrate that it may be formed by depositing or otherwise forming multiple separate layers 18*a*–18*c* . . . 18*n*. The layer 18 may have a thickness in the range of 100 Å to 4000 Å.

Although a composite of three layers is illustrated, layer 18 can be comprised of more layers. The types and thicknesses of the materials selected for the insulative dielectric layer 18 determine the gate 20 to emission tip 16 spacing. Hence, depending on the desired gate 20 to emission tip 16 spacing, the number and thickness of the insulating dielectric layers 18*a* . . . 18*n* is adjusted. The thickness of the insulating layers 18*a* and 18*c*, together with the selectively etchable insulating layer 18*b* also determines the gate 20 to substrate 12 spacing.

Figure 2:
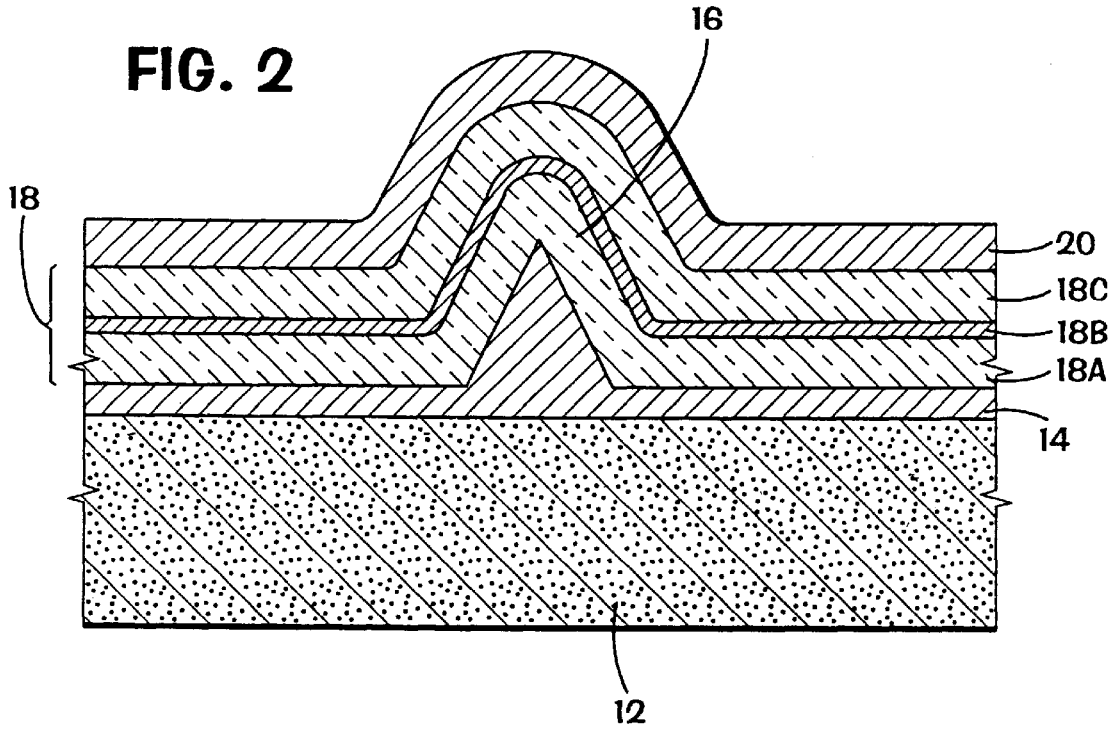
FIG. 2 is a cross-sectional schematic drawing of field emission display and emission tip having multiple conformal insulating layers and a conductive gate layer deposited thereon, in accordance with the present invention.

The composite insulating layer 18 comprises selectively etchable material layers 18*a*–18*c*. FIG. 2 illustrates one embodiment of the present invention in which the insulating layer 18 is comprised of oxide/nitride/oxide. The composite insulating layer 18, as shown in FIG. 2, is a conformal insulating layer 18. The insulating layers 18 are deposited on the emission tip 16 in a manner such that the insulating layers 18 conform to the conical shape of the emission tip 16.

In the illustrative embodiment, the insulating layer 18*a* is deposited on the emission tip 16. The insulating layer 18*a* is conformal in nature, and therefore uniformly blankets the emission tip 16 and the substrate surface 12. The illustrative embodiment uses silicon dioxide, tetraethylorthosilicate (TEOS), or other suitable oxide. Alternatively, the oxide layer 18*a* is grown on the emission tip 16 to a desired thickness. Growing the oxide layer 18*a*, likewise yields a conformal layer 18*a*. This is the method by which the emission tip 16 is simultaneously sharpened. As the oxide 18*a* is grown, silicon is consumed from the sides of the emission tips 16. When the oxide layer 18*a* is subsequently removed, the emission tip 16 becomes thinner, and consequently, sharper as a result.

The next layer in the illustrative embodiment is the insulating layer 18*b*, which is a conformally deposited nitride layer 18*b*, such as silicon nitride. A nitride 18*b* is selected because nitrides are selectively etchable with respect to oxides, which comprise the other insulating layers 18*a* and 18*c*, in the illustrative embodiment. Although other materials which are selectively etchable with respect to the insulating layers 18*a* and 18*c* may be used, (e.g., silicon oxynitride) a silicon nitride layer 18*b* is particularly effective against oxygen diffusion. Therefore, a nitride is useful for layers as thin as 1000 Å. However, the insulating layer 18*b* is preferably greater than 1000 Å. Silicon nitride is also preferred because it is easier to stop a mechanical planarization process, such as chemical mechanical planarization, on a nitride layer than on an oxide layer. Additionally, nitrides have a higher mechanical strength than oxides.

The silicon nitride layer 18*b* is preferably deposited by chemical vapor deposition (CVD, methods, including, but not limited to, low pressure chemical vapor deposition (LPCVD) and plasma enhanced chemical vapor deposition (PECVD). It is also possible to deposit the nitride layer 18*b* using dichlorosilane ($SiCl_2H_2$) and ammonia ($NH_3$).

The insulating layer 18*c* is disposed on the nitride layer 18*b*. In the illustrative embodiment, the layer 18*c* is silicon dioxide, tetraethylorthosilicate (TEOS), or other suitable oxide. The insulating layer 18*c* is also deposited by a technique, such as Chemical Vapor Deposition (CVD).

In another alternative embodiment of the process of the present invention, the emission tip 16 is sharpened, either before or during gate 20 formation, through an oxidation and etch process that reduces the potential for silicon and oxide flow. Following formation of the emission tip 16, the substrate 12 and the emission tip 16 are exposed to a mixture of gaseous oxygen and ozone at temperatures below 800° C. In this alternative embodiment of the process of the present invention, the preferred mixture of $O_2$ and $O_3$ ranges from about 95% $O_2$ and 5% $O_3$ (by weight) to about 85% $O_2$ and 15% $O_3$ by weight). The $O_3$ may be generated by any conventional means, such as arc discharge or plasma techniques. It is preferred that the oxygen used for the mixture be grade 5 or better. One preferred temperature range for the oxidation process is between about 650° C. and 750° C. It is anticipated that the more prevalent temperature range will be between about 700° C. and 750° C.

The duration of exposure will depend on the pre-sharpening condition of the emission tip 16. A relatively sharper emission tip 16 will require a thinner conformal oxide layer 18*a* and a correspondingly shorter exposure to the $O_2/O_3$ mixture. Conversely, a relatively more rounded emission tip 16 will require a thicker conformal oxide layer 18*a* and a correspondingly longer exposure. It is anticipated that the duration of exposure will typically range from about one-half to about one hour.

The mixture of $O_2$ and $O_3$ enables the oxidation process to occur below the high temperatures associated with typical dry oxidation processes, and without the potential flow of silicon and oxide associated with wet oxidation processes, even at temperatures below 800° C. It is believed that this is due to the heightened diffusivity and reactivity of negatively charged oxygen ions ejected from $O_3$ molecules upon contact with the silicon surface of the emission tip 16.

To slow the rate of reaction between the $O_2/O_3$ mixture and the silicon surface of the emission tip 16, diluent gases may be added to the mixture. The diluent gases are preferably, though not necessarily, inert gases, such as argon, krypton, nitrogen, or similar gases.

To achieve other desirable effects from the oxidation process, such as purification of the emission tip 16, the mixture may also include common gettering agents, such as trans-1,2-dichloroethylene ($C_2H_2Cl_2$), gaseous HCL, or similar agents, to attract metal ion impurities out of the emission tip 16. In the typical process flow, the emission tip 16 is first exposed to the $O_2/O_3$ mixture for an initial period. Subsequently, the getting agent is added to the mixture. Common gettering agents will have a tendency to degrade the $O_3$ gas. Accordingly, where a gettering agent is used, a higher than ordinary initial concentration of $O_3$ may be required to account for the loss of $O_3$ following introduction of the gettering agent.

Following formation of the oxide layer 18*a,* additional insulating layers may then be formed as previously disclosed. The insulating layers 18 may then be etched to expose the emission tip 16 as discussed below.

The next step in the process is the deposition of the conductive gate layer 20. The gate layer 20 may comprise a metal such as chromium or molybdenum, but the preferred material for this process is deemed to be doped polysilicon. The conductive material 20 is also preferably conformal in nature.

In one embodiment of the present invention, a buffer material is deposited to prevent undesired etching of the lower-lying portions of the conductive gate material layer during the mechanical polishing planarization step which follows. A suitable buffering material is a thin layer of $Si_3N_4$. The nitride buffer layer has the effect of protecting the emission tip 16, which is one advantage of performing this optional step. The buffering layer substantially impedes the progress of the mechanical planarization into the layer on which the buffering material is deposited.

The next step in the gate formation process is the mechanical planarization, which, as noted above, may be chemical mechanical polishing (CMP). Through the use of chemical and abrasive techniques, the buffer material as well as any other layers (e.g. the conductive material layer 20 and the conformal insulating layers 18*a*–18*c*) extending beyond the emission tip 16 are "polished" away. This is the manner by which the gate 20 and emission tips 16 of the present invention are self-aligned, as illustrated in FIG. 3.

In contrast, the gate etch masks of early field emission displays were manually aligned to emission tips. Manual alignment introduces variability into the process, which often results in less than optimum electron emission patterns. The self-aligned fabrication of emission tips 16 and gates 20 greatly reduces process variability, decreases manufacturing costs, and results in a display having greater image sharpness.

In general, CMP involves holding or rotating a wafer of semiconductor material against a wetted polishing surface under controlled chemical slurry, pressure, and temperature conditions.

A chemical slurry containing a polishing agent such as alumina or silica may be utilized as the abrasive medium. Additionally, the chemical slurry may contain chemical etchants. This procedure is used to produce a surface with a desired endpoint or thickness, which also has a polished and planarized surface, as shown in FIG. 3. Such apparatus for polishing are disclosed in U.S. Pat. Nos. 4,193,226 and 4,811,522. Another such apparatus is manufactured by Westech Engineering and is designated as a Model 372 Polisher.

CMP is performed substantially over the entire wafer surface, and at a high pressure. Initially, CMP will proceed at a very fast rate, as the peaks are being removed, then the rate will slow dramatically as the surface becomes more planar. The removal rate of the CMP is proportionally related to the pressure and the hardness of the surface being planarized.

FIG. 3 illustrates the intermediate step in the gate formation process following the CMP. A substantially planar surface is achieved, and the conformal insulating layers 18*a*–18*c* are thereby exposed. FIG. 3 shows the means by which the conformal insulating layers 18*a*–18*c* define the gate 20 to emission tip 16 spacing, as well as the means by which the gate 20 is self-aligned.

The next process step is a wet etching of the selectively-etchable insulating layers 18*a*–18*c* to expose the emission tip 16. The insulating layer 18*b* is selectively etchable with respect to the oxide insulating layers 18*a* and 18*c*. FIG. 4 illustrates the field emission device 10 after the insulating cavity has been so etched. The device 10 is dipped in hot phosphoric acid to etch back the nitride layer 18*b* to a point at which the fins 28 do not interfere with the emissions of the emission tip 16. A wet buffered oxide etch having sufficient selectivity to nitride is preferably used to remove the desired portions of insulating layers 18*a* and 18*c*. Hydrofluoric acid (HF) is an example of an etchant which has a sufficient selectivity to nitride. These are the preferred etchants due to their cost and commercial availability. Alternatively, the oxide layers 18*a* and 18*c* are isotropically etched in a plasma environment using suitable etchant gases commonly known in the art.

Once the insulating layers 18*a* and 18*c* have been etched back, the fins 28 in the nitride layer 18*b* becomes apparent. These fins 28 increase the surface distance of the leakage path, as indicated by the dotted lines in FIG. 5. If multiple nitride layers 18*b* are formed, a series of fins 28 results.

If desired, the emission tip 16 may, optionally, be coated with a low work-function material. Low work function materials include, but are not limited to cermet ($Cr_3Si$+$SiO_2$), cesium, rubidium, tantalum nitride, barium, chromium silicide, titanium carbide, molybdenum, and niobium.

Coating of the emission tips 16 may be accomplished in one of many ways. The low work-function material or its precursor may be deposited through sputtering or other suitable means on the emission tips 16. Certain metals (e.g., titanium or chromium) may be reacted with the silicon of the emission tips 16 to form silicide during a rapid thermal processing (RTP) step. Following the RTP step, any unreacted metal is removed from the emission tip 16. In a nitrogen ambient, deposited tantalum may be converted during RTP to tantalum nitride, a material having a particularly low work function. The coating process variations are almost endless.

This results in an emission tip 16 that may not only be sharper than a plain silicon tip, but that also has greater resistance to erosion and a lower work function. The silicide is formed by the reaction of the refractory metal with the underlying silicon by an anneal step.

In an alternative embodiment of the present invention (not shown), a flowable insulating layer is interposed among the conformal insulating layers 18*a*–18*c*, in the formation of composite layer 18. The flowable layer must still be selectively etchable with respect to the other insulating layers of the composite 18.

In this embodiment, a conformally deposited silicon nitride layer is formed first, and alone substantially determines the gate 20 to emission tip 16 spacing. Although other materials which are selectively etchable with respect to the flowable insulating layer may be used, (e.g., $SiO_2$, and silicon oxynitride) a nitride layer is particularly effective against oxygen diffusion and, therefore, is useful for layers as thin as 1000 Å, but preferably greater than 1000 Å. This is particularly advantageous, since small gate 20 to emission tip 16 distances result in lower emission drive voltages.

The next step is the deposition of the flowable insulating layer. The flowable insulating layer comprises at least one of: spin-on-glass (SOG), borophosphosilicate glass (BPSG), or a polyimide, or other suitable material, including, but not limited to, other spin on dielectrics or flowable dielectrics. Under certain conditions, such materials flow easily over the surface of the wafer, resulting in a densified planarized layer. The thickness of the flowable insulating layer, together with the conformal nitride layer determines the gate 20 to substrate 12 spacing.

One preferred flowable insulator is BPSG. The BPSG layer is also initially deposited by CVD using a phosphorous source such as phosphine ($PH_3$) gas. The wafer surface may also be exposed to a boron source such a diborane ($B_2H_6$) gas. The resultant BPSG layer initially covers the emission tip 16, and is then reflowed. In general, the BPSG reflow is performed at a temperature in the range of 700° C. to 1050° C. In practice, the upper limit of the reflow temperature will be controlled by the effects of the reflow on the substrate and other related structures. In one embodiment, the BPSG layer is heated to a temperature of approximately 1000° C. to cause a slight flow of the flowable insulating material, preferably, to a substantially uniform level below the emission tip 16.

After the reflow step, the emission tip 16 is exposed, thereby providing an opportunity to add another conformal insulating layer prior to the deposition of the conductive gate material layer 20. An insulating material which is selectively etchable with respect to the flowable layer is formed thereon to further adjust the spacing between the gate 20 and the emission tip 16.

After the composite insulating layer 18 is formed and the conductive gate layer 20 is deposited, a mechanical planarization process is undertaken to planarize the layers, as in the illustrated embodiment. A series of selective etch steps are then carried out, as previously described, to expose the emission tip 16 and adjust the size of the insulator fins.

While the particular process as herein shown and disclosed in detail is fully capable of obtaining the objects and advantages herein before stated, it is to be understood that it is merely illustrative of the presently preferred embodiments of the invention and that no limitations are intended to the details of construction or design herein shown other than as described in the appended claims.

What is claimed:

1. A field emitter display having reduced surface leakage, said field emitter display comprising:

at least one emitter tip sharpened by forming an insulating layer on said semiconductor substrate and said emission tip by exposing said semiconductor substrate and said emission tip to a mixture of gases containing oxygen and ozone and selectively removing a portion of said insulating layer to expose said emission tip to leave a dielectric region surrounding said emission tip;

a dielectric region surrounding said emitter tip, said dielectric region being formed of a composite of insulative layers, at least one of said insulative layers having fins extending toward said emitter tip; and a conductive gate disposed superjacent said dielectric region.

2. The field emitter device according to claim 1, wherein said composite of insulative layers comprises at least a first oxide layer, a nitride layer, and a second oxide layer.

3. The field emitter device according to claim 2, wherein said fins extend from said nitride layer, said fins being spaced a sufficient distance from said emitter tip to prevent interference with emission.

4. The field emitter device according to claim 3, wherein said conductive gate comprises polysilicon.

5. The field emitter device according to claim 4, wherein at least one of said oxide layers comprises tetraethylorthosilicate (TEOS).

6. The field emitter device according to claim 5, wherein said emitter tip is disposed in an array of like emitter tips.

7. The field emitter device according to claim 6, wherein said composite of insulative layers further comprises a second nitride layer, said second nitride layer having additional fins extending therefrom.

8. A field emitter device comprising:

a substrate having an electron emitter thereon, said electron emitter having a base portion and a tip portion, said tip portion sharpened by forming an insulating layer on said semiconductor substrate and said emission tip by exposing said semiconductor substrate and said emission tip to a mixture of gases containing oxygen and ozone and selectively removing a portion of said insulating layer to expose said emission tip to leave a dielectric region surrounding said emission tip;

a gate structure adjacent said electron emitter; and a dielectric region between said electron emitter and said gate structure, said dielectric region having an uneven surface extending between said electron emitter and said gate structure.

9. The device, as set forth in claim 8, wherein said gate structure is disposed adjacent said tip portion of said electron emitter.

10. The device, as set forth in claim 8, wherein said gate structure comprises polysilicon.

11. The device, as set forth in claim 8, wherein said dielectric region comprises a plurality of dielectric layers, at least one of said plurality of dielectric layers extending toward said electron emitter to a greater extent than the other of said plurality of dielectric layers.

12. The device, as set forth in claim 8, wherein said dielectric region comprises a plurality of dielectric layers, a first plurality of said plurality of dielectric layers extending toward said electron emitter in comparison to a second plurality of said plurality of dielectric layers.

13. The device, as set forth in claim 8, wherein said dielectric region comprises a plurality of dielectric layers, at least one of said plurality of dielectric layers being spaced within a first distance from said electron emitter and the other of said plurality of dielectric layers being spaced at least a second distance from said electron emitter, said first distance being less than said second distance.

14. The device, as set forth in claim 8, wherein said dielectric region comprises a plurality of dielectric layers, a first plurality of said plurality of dielectric layers being spaced within a first distance from said electron emitter and a second plurality of said plurality of dielectric layers being spaced at least a second distance from said electron emitter, said first distance being less than said second distance.

15. A field emitter device comprising:

a substrate having an electron emitter thereon, said electron emitter having a base portion and a tip portion, said tip portion sharpened by forming an insulating layer on said semiconductor substrate and said emission tip by exposing said semiconductor substrate and said emission tip to a mixture of gases containing oxygen and ozone and selectively removing a portion of said insulating layer to expose said emission tip to leave a dielectric region surrounding said emission tip;

a gate structure adjacent and spaced apart from said electron emitter; and a dielectric region adjacent said electron emitter, said dielectric region being formed from a plurality of layers, at least one of said plurality of layers extending into a space between said dielectric region and said electron emitter.

16. The device, as set forth in claim 15, wherein said gate structure is disposed adjacent said tip portion of said electron emitter.

17. The device, as set forth in claim 15, wherein said gate structure comprises polysilicon.

18. The device, as set forth in claim 15, wherein a first plurality of said plurality of layers extends into said space.

19. The device, as set forth in claim 15, wherein said at least one of said plurality of layers is spaced within a first distance from said electron emitter and the other of said plurality of layers is spaced at least a second distance from said electron emitter, said first distance being less than said second distance.

20. The device, as set forth in claim 15, wherein a first plurality of said plurality of layers is spaced within a first distance from said electron emitter and a second plurality of said plurality of layers is spaced at least a second distance from said electron emitter, said first distance being less than said second distance.

21. A field emitter device comprising:

a substrate having an electron emitter thereon, said electron emitter having a base portion and a tip portion, said tip portion sharpened by forming an insulating layer on said semiconductor substrate and said emission tip by exposing said semiconductor substrate and said emission tip to a mixture of gases containing oxygen and ozone and selectively removing a portion of said insulating layer to expose said emission tip to leave a dielectric region surrounding said emission tip;

a gate structure surrounding said tip portion of said electron emitter; and a dielectric region surrounding said base portion of said electron emitter, said dielectric region being formed from a plurality of layers, said plurality of layers being nonuniformly spaced from said base portion of said electron emitter.

22. The device, as set forth in claim 21, wherein said gate structure comprises polysilicon.

23. The device, as set forth in claim 21, wherein at least one of said plurality of layers extends toward said base portion of said electron emitter to a greater extend than the other of said plurality of layers.

24. The device, as set forth in claim 21, wherein a first plurality of said plurality of layers extends toward said base portion of said electron emitter to a greater extend than a second plurality of said plurality of layers.

25. The device, as set forth in claim 21, wherein said at least one of said plurality of layers is spaced within a first distance from said electron emitter and the other of said plurality of layers is spaced at least a second distance from said electron emitter, said first distance being less than said second distance.

26. The device, as set forth in claim 21, wherein a first plurality of said plurality of layers is spaced within a first distance from said electron emitter and a second plurality of said plurality of layers is spaced at least a second distance from said electron emitter, said first distance being less than said second distance.

27. A field emitter device comprising:

a substrate having an electron emitter extending therefrom, said electron emitter having a base portion and a tip portion, said base portion being coupled to said substrate, said tip portion sharpened by forming an insulating layer on said semiconductor substrate and said emission tip by exposing said semiconductor substrate and said emission tip to a mixture of gases containing oxygen and ozone and selectively removing a portion of said insulating layer to expose said emission tip to leave a dielectric region surrounding said emission tip;

a dielectric region surrounding said base portion of said electron emitter, said dielectric region being disposed on said substrate, said dielectric region having a protrusion extending toward said electron emitter; and a gate structure adjacent said tip portion of said electron emitter.

28. The device, as set forth in claim 27, wherein said gate structure comprises polysilicon.

29. The device, as set forth in claim 27, wherein said dielectric region comprises a plurality of dielectric layers, at least one of said plurality of dielectric layers extending toward said electron emitter to a greater extent than the other of said plurality of dielectric layers.

30. The device, as set forth in claim 27, wherein said dielectric region comprises a plurality of dielectric layers, a first plurality of said plurality of dielectric layers extending toward said electron emitter in comparison to a second plurality of said plurality of dielectric layers.

31. The device, as set forth in claim 27, wherein said dielectric region comprises a plurality of dielectric layers, at least one of said plurality of dielectric layers being spaced within a first distance from said electron emitter and the other of said plurality of dielectric layers being spaced at least a second distance from said electron emitter, said first distance being less than said second distance.

32. The device, as set forth in claim 27, wherein said dielectric region comprises a plurality of dielectric layers, a first plurality of said plurality of dielectric layers being spaced within a first distance from said electron emitter and a second plurality of said plurality of dielectric layers being spaced at least a second distance from said electron emitter, said first distance being less than said second distance.

33. A field emitter device comprising:

a substrate having an electron emitter thereon, said electron emitter having a base portion and a tip portion, said base portion being coupled to said substrate, said tip portion sharpened by forming an insulating layer on said semiconductor substrate and said emission tip by exposing said semiconductor substrate and said emission tip to a mixture of gases containing oxygen and ozone and selectively removing a portion of said insulating layer to expose said emission tip to leave a dielectric region surrounding said emission tip;

a first dielectric region adjacent said electron emitter, said first dielectric region being spaced apart from said electron emitter by a first distance;

a second dielectric region adjacent said first dielectric region, said second dielectric region being spaced apart from said electron emitter by a second distance, said second distance being greater than said first distance; and a gate structure adjacent and spaced apart from said electron emitter.

* * * * *